US005902711A

United States Patent [19]

Smith et al.

[11] Patent Number: 5,902,711

[45] Date of Patent: May 11, 1999

[54] METHOD TO MEDIA MILL PARTICLES USING CROSSLINKED POLYMER MEDIA AND ORGANIC SOLVENT

[75] Inventors: Dennis E. Smith; James R. Bennett; Louis J. Sorriero, all of Rochester, N.Y.

[73] Assignee: Eastman Kodak Company, Rochester, N.Y.

[21] Appl. No.: 08/881,952

[22] Filed: Jun. 25, 1997

[51] Int. Cl.[6] ..... G03G 9/00; B02C 21/00

[52] U.S. Cl. ..... 430/137; 241/16

[58] Field of Search ..... 430/137, 111; 241/15, 16

[56] References Cited

U.S. PATENT DOCUMENTS

| | | | |
|---|---|---|---|
| 4,547,449 | 10/1985 | Alexandrovich et al. | 430/115 |
| 4,833,060 | 5/1989 | Nair et al. | 430/137 |
| 4,965,131 | 10/1990 | Nair et al. | 428/407 |
| 5,262,269 | 11/1993 | Nair et al. | 430/111 |
| 5,478,705 | 12/1995 | Czekai et al. | 430/449 |
| 5,500,331 | 3/1996 | Czekai et al. | 430/449 |
| 5,513,803 | 5/1996 | Czekai et al. | 241/16 |
| 5,716,751 | 2/1998 | Bertrand et al. | 430/137 |

*Primary Examiner*—John Goodrow
*Attorney, Agent, or Firm*—Andrew J. Anderson

[57] ABSTRACT

A process of forming milled solid particles of a compound comprising milling solid particles of the compound in a liquid organic medium continuous phase in the presence of polymeric milling media to reduce the average size of the compound particles, wherein the liquid continuous phase comprises a solvent for the milling media polymer in the uncrosslinked form and the milling media is crosslinked sufficiently to prevent 50 vol. % swelling of the polymeric milling media in the liquid continuous phase within four hours at 25° C. In various preferred embodiments of the invention, polymeric milling media having a mean particle size of less than about 100 μm in the unswelled state (i.e., prior to addition to the liquid organic continuous phase) is used; the compound particles are milled to an average particle size of less than 100 nm; the compound comprises electrophotographic toner pigment; the liquid continuous phase comprises an ethylenically unsaturated polymerizable monomer; and the milling media polymer comprises polymerized styrene and divinylbenzene monomers. In an additional preferred embodiment of the invention wherein the compound comprises electrophotographic toner pigment and the liquid organic medium continuous phase comprises an ethylenically unsaturated polymerizable monomer, electrophotographic toner particles are formed by polymerizing the ethylenically unsaturated polymerizable monomer after the toner pigment compound is milled. It is a particularly advantageous feature of this invention that there is provided a method of preparing extremely fine solid particles of a compound free of unacceptable contamination and/or discoloration using polymeric milling media in a liquid continuous phase which is an effective solvent for the milling media polymer in uncrosslinked form. It is a further advantage of the invention to allow for preparing electrophotographic toner particles directly from a milled toner pigment particle dispersion without first needing to separate the milled particles from the liquid milling medium continuous phase. The ability to form extremely fine, e.g., less than 100 nm, size pigment particles in accordance with the invention is especially advantageous where toner particles are subsequently formed by suspension polymerization of ethylenically unsaturated monomers after milling of the pigment particles.

17 Claims, No Drawings

METHOD TO MEDIA MILL PARTICLES USING CROSSLINKED POLYMER MEDIA AND ORGANIC SOLVENT

FIELD OF THE INVENTION

This invention relates to milling material using polymeric milling media. In particular, it relates to milling solid particles of a compound using crosslinked polymeric milling media in a liquid organic milling medium continuous phase.

BACKGROUND OF THE INVENTION

Electrophotographic toner particles typically comprise a mixture of a polymer and very fine pigment particles. The toner particles may be made by dispersing the pigments in an organic solvent, such as ethyl acetate or methylene chloride, along with the dissolved polymer and other addenda followed by droplet formation in an aqueous phase and removal of the solvent to solidify the particles (see, e.g., U.S. Pat. No. 4,833,060). Another technique for making electrophotographic toner particles is to disperse pigments in ethylenically unsaturated monomers along with other addenda followed by droplet formation in an aqueous phase and suspension polymerization of the ethylenically unsaturated monomers to solidify the particles (see, e.g., U.S. Pat. No. 4,965,131).

Reducing the pigment's particle size prior to incorporation into a toner particle is desirable in order to increase the covering power of the pigment and therefore reduce the amount required. In view of the electrophotographic toner particle manufacturing procedures described above, it is desirable to mill the pigment particles directly in the organic solvent used to dissolve the toner particle polymer, or in the monomer solution used to form the toner particle, thereby eliminating the need to separate the milled pigment from the liquid milling medium continuous phase prior to formation of the toner particle. The use of conventional organic solvent insoluble milling media such as steel, ceramic or glass beads in an attrition mill to reduce the pigment particle size, however, suffers from several problems. First, excessive levels of metallic, ceramic or other contamination usually result. Metallic contamination is particularly undesirable in an electrophotographic toner where careful control of the toner particle's charging properties is required. Second, while the use of very fine milling media can result in desirably smaller pigment particles, it is generally difficult to obtain metallic, ceramic or glass milling media of a size smaller than 100 mm.

The use of polymeric milling media to grind materials down to a very small size is known, such as described in U.S. Pat. No. 5,478,705, which discloses milling of compounds useful in imaging elements using polymeric milling media, preferably based upon crosslinked or non-crosslinked polymers made from acrylic and styrenic monomers. U.S. Pat. No. 5,500,331 teaches the advantages associated with the use of milling media smaller than 100 $\mu$m when milling compounds useful in imaging, and specifically discloses the use of polymeric milling media of such size. While both dry and wet milling is possible when using polymeric milling media, wet milling is generally preferred.

It would be desirable to be able to effectively mill electrophotographic pigment particles using polymeric milling media directly in the organic solvent used to dissolve the toner particle polymer, or in the monomer solution used to form the toner particle, thereby eliminating the problems associated with the use of steel, ceramic or glass beads as the milling media. Such organic liquid media, however, are generally effective solvents for useful polymeric milling media polymers, such as polymers made from acrylic and styrenic monomers, while liquid dispersion medium which does not dissolve polymeric milling media is generally recommended when using polymeric milling media. U.S. Pat. No. 5,478,705, for instance, states that the preferred liquid dispersion medium is water (col 5, line 15), and while additional useful liquid dispersion mediums are indicated (col 4, line 19), all are not significant solvents even for uncrosslinked polystyrene. The use of polymeric milling media in liquid dispersion media comprising good solvents for the polymers which make up the milling media would not be expected to be effective, even if the polymers were sufficiently crosslinked to make the polymers insoluble in the liquid media, due to the plasticizing, or softening effect of the solvent on the polymer.

Additionally, it would also be desirable to provide dispersions of other solid compounds useful in imaging elements in a liquid continuous phase which comprises a good solvent for polymers which would make effective milling media when preparing solvent based coating compositions containing such compounds. The solvent based coating compositions must have unique combinations of properties such as volatility, viscosity, surface tension, etc., to enable effective coating processes, which properties may be advantageously met by liquids which are frequently good solvents for many polymers.

Accordingly, it is an object of the invention to be able to provide a process for forming a dispersion of small solid particles in a liquid dispersion medium continuous phase which comprises a good solvent for polymers which would make effective milling media.

SUMMARY OF THE INVENTION

We have discovered that extremely fine particles, e.g., of size less than 100 nm, of a solid compound can be effectively prepared by milling in a liquid organic medium continuous phase in the presence of polymeric milling media, wherein the continuous phase comprises an effective solvent for the milling media polymer in the uncrosslinked form, if the milling media polymer is crosslinked extensively enough to sufficiently limit swelling of the milling media.

More specifically, in accordance with this invention, there is provided a process of forming milled solid particles of a compound comprising milling solid particles of the compound in a liquid organic medium continuous phase in the presence of polymeric milling media to reduce the average size of the compound particles, wherein the liquid continuous phase comprises a solvent for the milling media polymer in the uncrosslinked form and the milling media is crosslinked sufficiently to prevent 50 vol. % swelling of the polymeric milling media in the liquid continuous phase within four hours at 25° C.

In various preferred embodiments of the invention, polymeric milling media having a mean particle size of less than about 100 $\mu$m in the unswelled state (i.e., prior to addition to the liquid organic continuous phase) is used; the compound particles are milled to an average particle size of less than 100 nm; the compound comprises electrophotographic toner pigment; the liquid continuous phase comprises an ethylenically unsaturated polymerizable monomer; and the milling media polymer comprises polymerized styrene and divinylbenzene monomers.

In an additional preferred embodiment of the invention wherein the compound comprises electrophotographic toner pigment and the liquid organic medium continuous phase comprises an ethylenically unsaturated polymerizable monomer, electrophotographic toner particles are formed by polymerizing the ethylenically unsaturated polymerizable monomer after the toner pigment compound is milled.

ADVANTAGEOUS EFFECT OF THE INVENTION

It is a particularly advantageous feature of this invention that there is provided a method of preparing extremely fine solid particles of a compound free of unacceptable contamination and/or discoloration using polymeric milling media in a liquid continuous phase which is an effective solvent for the milling media polymer in uncrosslinked form. It is a further advantage of the invention to allow for preparing electrophotographic toner particles directly from a milled toner pigment particle dispersion without first needing to separate the milled particles from the liquid milling medium continuous phase. The ability to form extremely fine, e.g., less than 100 nm, size pigment particles in accordance with the invention is especially advantageous where toner particles are subsequently formed by suspension polymerization of ethylenically unsaturated monomers after milling of the pigment particles.

DETAILED DESCRIPTION OF THE INVENTION

In the method of this invention, solid particles of a compound are milled to effectively reduce the average size thereof, preferably to a submicron particle size, by wet milling the compound in the presence of polymeric milling media. The particle of a solid compound may be reduced in accordance with the invention by deagglomerating aggregated solid particles, or by fracture of individual crystalline or amorphous particles.

In general, polymeric milling media suitable for use herein comprise polymeric resins which are chemically and physically inert, and of sufficient hardness and friability to enable them to avoid being chipped or crushed during milling. The preferred method of making polymeric grinding media is by suspension polymerization of acrylic and styrenic monomers. Methyl methacrylate and styrene are preferred monomers because they are inexpensive, commercially available materials which make acceptable polymeric grinding media. Other acrylic and styrenic monomers have also been demonstrated to work. Styrene is preferred.

In accordance with the invention, the polymeric milling media is sufficiently crosslinked to prevent 50 vol. % swelling of the polymer in the liquid milling medium within 4 hours of contact. Any co-monomer with more than one ethylenically unsaturated group can be used in the preparation of the polymeric milling media to provide the crosslinking functionality, such as divinylbenzene and ethylene glycol dimethacrylate. While only a few weight percent crosslinker may be sufficient to make a polymer insoluble in an organic medium which is an effective solvent for the polymer in uncrosslinked form, typically a significantly higher level will be required to prevent substantial swelling of the polymeric media in such solvents in accordance with the invention. The critical amount of crosslinking monomer required to be incorporated into the polymer to restrict swelling of the polymeric milling media to less than 50 vol. % will depend upon the composition of the liquid milling medium continuous phase organic solvent and of the polymeric media. In general, however, it will be advantageous to provide at least about 10 mole %, more preferably at least 20 mole %, and most preferably at least about 25 mole % crosslinking monomer, and use of polymers of the following formula are preferred:

$$(A)_x(B)_y \quad \text{(I)}$$

where A is derived from one or more monofunctional ethylenically unsaturated monomers, B is derived from one or more monomers which contains at least two ethylenically unsaturated groups, x is from 0 to about 90 mole %, and y is from about 10 to 100 mole %, preferably from about 20 to 100 mole %, and most preferably from about 25 to 100 mole %. If less than about 10 mole % crosslinking monomer is included, the polymeric milling media may not be sufficiently crosslinked to limit swelling in many organic solvents to less than 50 vol. %. In general, the higher the mole % of crosslinking monomer in the polymer, the more resistant the polymer will be to swelling in organic solvents, and the more effective the polymer will be as milling media in a liquid continuous phase which comprises an effective organic solvent for the polymer in uncrosslinked form.

Suitable ethylenically unsaturated monomers which can be used as component A may include, for example, the following monomers and their mixtures: acrylic monomers, such as acrylic acid, or methacrylic acid, and their alkyl esters such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate; the hydroxyalkyl esters of the same acids, such as, 2-hydroxyethyl acrylate, 2-hydroxyethyl methacrylate, and 2-hydroxypropyl methacrylate; the nitrites and amides of the same acids, such as, acrylonitrile, methacrylonitrile, acrylamide and methacrylamide; vinyl compounds, such as, vinyl acetate, vinyl propionate, vinylidene chloride, vinyl chloride, and vinyl aromatic compounds such as styrene, t-butyl styrene, ethylvinylbenzene, vinyl toluene; dialkyl esters, such as, dialkyl maleates, dialkyl itaconates, dialkyl methylene-malonates and the like. Preferably, monomer A is styrene, vinyl toluene, ethylvinylbenzene, or methyl methacrylate. Most preferably monomer A is styrene or ethylvinylbenzene.

Suitable ethylenically unsaturated monomers which can be used as component B are monomers which are polyfunctional with respect to the polymerization reaction, and may include, for example, the following monomers and their mixtures: esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as, ethylene glycol diacrylate, ethylene glycol dimethacrylate, triethylene glycol dimethacrylate, 1,4-butanediol dimethacrylate, 1,3-butanediol dimethacrylate, pentaerythritol tetraacrylate, trimethylol propane trimethacrylate and polyfunctuional aromatic compounds such as divinylbenzene and the like. Preferably, monomer B includes ethylene glycol dimethacrylate, ethylene glycol diacrylate, 1,4-butanediol dimethylacrylate or divinylbenzene. Most preferably, monomer B is divinylbenzene.

As to divinylbenzene, although available as pure monomer for laboratory use, it is most commonly sold commercially as a mixture of divinylbenzene and ethylvinylbenzene, available, for instance, from Dow Chemical Company as DVB-55 (typical assay 55.8% divinylbenzene and 43.0% ethylvinylbenzene) or DVB-HP (typical assay 80.5% divinylbenzene and 18.3% ethylvinylbenzene). For polystyrene media crosslinked with divinylbenzene used in a liquid milling medium continuous phase comprising styrene monomer in accordance with preferred embodiments of the invention, it is generally preferable to to include at least about 50 wt % of commercially available (55% assay) divinylbenzene into the polystyrene polymer, thereby providing at least about 24 mole % crosslinking monomer, and a copolymer of 20 wt % styrene, 80 wt % commercial (55% assay) divinylbenzene is especially preferred, providing about 42 mole % crosslinking monomer.

The milling media particles for use in accordance with this invention can be made by various well-known techniques in the art, such as, for example, crushing, grinding or pulverizing of polymer down to the desired size, emulsion polymerization, dispersion polymerization, suspension polymerization, solvent evaporation from polymer solution dispersed as droplets, and the like (see, for example, Arshady, R. in "Colloid & Polymer Science", 1992, No 270, pages 717–732; G. Odian in "Principles of Polymerization", 2nd Ed. Wiley(1981); and W. P. Sorenson and T. W. Campbell in "Preparation Method of Polymer Chemistry", 2nd Ed, Wiley (1968)). A preferred method of preparing polymer particles in accordance with this invention is by a limited coalescence technique where polyaddition polymerizable monomer or monomers are added to an aqueous medium containing a particulate suspending agent to form a discontinuous (oil droplet) phase in a continuous (water) phase. The mixture is subjected to shearing forces, by agitation, homogenization and the like to reduce the size of the droplets. After shearing is stopped an equilibrium is reached with respect to the size of the droplets as a result of the stabilizing action of the particulate suspending agent in coating the surface of the droplets and then polymerization is completed to form an aqueous suspension of polymer particles. This process is described in U.S. Pat. Nos. 2,932,629; 5,279,934; and 5,378,577; the disclosures of which are incorporated herein by reference.

Removal of residual monomers from the polymeric media after synthesis may be desirable, and can be accomplished by any number of methods common to polymer synthesis such as thermal drying, stripping by inert gases such as air or nitrogen, solvent extraction or the like. Drying and stripping processes are limited by the low vapor pressure of the residual monomers and large bead sizes resulting in long diffusion paths. Solvent extraction is therefore preferred. Any solvent can be used such as acetone, toluene, alcohols such as methanol, alkanes such as hexane, supercrital carbon dioxide and the like. Acetone is preferred. While solvents which are effective in removing residual monomers typically dissolve the polymer made from the monomer, or make the polymer sticky and difficult to handle, crosslinked polymers in accordance with the invention are advantageously generally made insoluble in the solvent which has an affinity for the monomer.

The polymeric resin typically will have a density from 0.9 to 3.0 g/cm$^3$, although densities outside this range are also possible. Higher density resins are preferred inasmuch as it is believed that these provide more efficient particle size reduction.

The polymeric milling media preferably is substantially spherical in shape. For fine grinding, the polymeric milling media particles preferably have a mean (volume average) particle size of less than about 100 microns in size, more preferably less than about 75 microns, and most preferably less than or equal to about 50 microns in the unswelled state. Excellent particle size reduction has been achieved with media having a particle size of about 25 microns, and media milling with media having a particle size of 5 microns or less is contemplated.

In preferred embodiments, this invention is practiced in accordance with a wet-milling process, such as described in U.S. Pat. No. 5,145,684 and European Patent Application 498,492. Useful liquid dispersion media continuous phases in accordance with the instant invention comprise an effective solvent for the polymeric milling media in uncrosslinked form. Such liquid media may comprise a conventional organic solvent, such as ethyl acetate, methylene chloride, THF, DMF, dioxane, ketones such as acetone and DEK, or any of the other solvents for polymers listed in U.S. Pat. No. 4,833,060, the entire disclosure of which is incorporated herein by reference, or an ethylenically unsaturated monomer solution such as a styrene or methylmethacrylate solution or any of the other monomer solutions listed in U.S. Pat. No. 4,965,131, the entire disclosure of which is incorporated herein by reference. The liquid dispersion medium continuous phase will be considered to comprise an effective solvent for the polymeric milling media in uncrosslinked form where the milling media polymer composition in the absence of any crosslinking comonomer, or where crosslinking has been effectively inhibited, has a solubility in the liquid media continuous phase of at least about 1 mg/ml. Crosslinked polymeric milling media in accordance with the invention will be substantially insoluble in such liquid media, i.e., will have a solubility of less than 1 mg/ml.

Surface modifiers can be included during milling, or may be added after milling to aid in dispersion stabilization, and may be selected from known organic and inorganic materials such as surfactants and polymers described in the above referenced publications. Particularly useful dispersants for use in liquid organic phase systems include polymeric ionomers such as described in U.S. Pat. No. 4,547,449, the disclosure of which is incorporated by reference herein. Surface modifiers typically may be present in an amount 0.1–90%, preferably 1–80% by weight based on the total weight of the dry particles in the milled dispersion.

Milling can take place in any suitable grinding mill. Suitable mills include an airjet mill, a roller mill, a ball mill, an attritor mill, a vibratory mill, a planetary mill, a sand mill and a bead mill. A high energy media mill is preferred when the grinding media consists essentially of the polymeric resin. The mill can contain a rotating shaft.

The preferred proportions of the milling media, the compound to be milled, the liquid dispersion medium and surface modifier can vary within wide limits and depends, for example, upon the particular material selected, the size and density of the milling media, the type of mill selected, etc. The process can be carried out in a continuous, batch or semi-batch mode. Such process may comprise, for example:

Batch Milling

A slurry of milling media, liquid, active material (i.e., material to be reduced in size dispersed in the liquid and stabilized by the stabilizer) and stabilizer is prepared using simple mixing. This slurry may be milled in conventional high energy batch milling processes such as high speed attritor mills, vibratory mills, ball mills, etc. This slurry is milled for a predetermined length of time to allow comminution of the active material to a minimum particle size. After milling is complete, the dispersion of active material is separated from the grinding media by a simple sieving or filtration.

Continuous Media Recirculation Milling

A slurry of milling media, liquid, active material and stabilizer as indicated above may be continuously recirculated from a holding vessel through a conventional media mill which has a media separator screen adjusted to allow free passage of the media throughout the circuit. After milling is complete, the dispersion of active material is separated from the grinding media by simple sieving or filtration.

Mixed Media Milling

A slurry of <100 μm milling media, liquid, active material and stabilizer as indicated above may be continuously recirculated from a holding vessel through a conventional media mill containing milling media >250 μm. This mill should have a screen separator to retain the large media in the milling chamber while allowing passage of the small media through the milling chamber. After milling is complete, the dispersion of active material is separated from the grinding media by simple sieving or filtration.

In high energy media mills, it frequently is desirable to leave the milling vessel up to half filled with air, the remaining volume comprising the milling media and the liquid dispersion media. This permits a cascading effect within the vessel on the rollers which permits efficient milling. However, when foaming is a problem during wet milling, the vessel can be completely filled with the liquid dispersion medium.

The attrition time and temperature can vary widely and depends primarily upon the particular compound useful in imaging (or other material), mechanical means and residence conditions selected, the initial and desired final particle size and so forth. For ball mills, processing times from several days to weeks may be required. On the other hand, residence times of less than about 8 hours are generally required using high energy media mills. As most of the particle size reduction is typically accomplished within the first few hours of milling time, effective milling can generally be accomplished where polymeric milling media particle size swelling is limited to less than 50 vol. % within four hours in accordance with the invention. Where milling times of substantially longer than 4 hours are required, the polymeric milling media is preferably sufficiently crosslinked to prevent swelling of 50 vol. % or more for longer longer than 4 hours, and more preferably for the duration of the milling step.

After attrition is completed, the milling media is separated from the milled particulate product using conventional separation techniques, such as by filtration, sieving through a mesh screen, and the like.

The instant invention is directed towards a process of milling solid particles of a compound in a liquid dispersion medium. The compound accordingly must be poorly soluble in the liquid dispersion medium. By "poorly soluble", it is meant that the compound has a solubility in the liquid dispersion medium of less that about 10 mg/ml, and preferably of less than about 1 mg/ml.

In one embodiment of the invention, the compound to be milled comprises a compound useful in imaging elements, such as described in U.S. Pat. Nos. 5,478,705, 5,500,331, and 5,513,803, the disclosures of which are incorporated by reference herein. In a preferred embodiment of the invention, the compound to be milled comprises an electrophotographic toner pigment. The electrophotographic pigment may comprise any conventional pigment, such as those mentioned in the Colour Index, Vol. 1 and 2, Second Edition. Preferred pigments include cyan, magenta, yellow, and black pigments. Useful preferred pigments include, e.g., Pigment Black 7, Pigment Red 122, Pigment Yellow 74, and bis(phthalocyanylalumino)tetraphenyldisiloxane (a modified Pigment Blue 15).

After milling of an electrophotographic pigment with crosslinked polymeric milling media in an organic solvent continuous phase to form a pigment dispersion in accordance with the invention and separation of the milling media, electrophotographic toner particles may be made by dissolving a polymer in the milled pigment dispersion along with addition of other conventional addenda, including optionally additional solvent, followed by droplet formation in an aqueous phase and removal of the solvent to solidify the particles as disclosed, e.g., in U.S. Pat. No. 4,833,060. Alternatively, electrophotographic toner particles may be made by milling of the toner pigment with crosslinked polymeric milling media in a liquid milling medium continuous phase comprising ethylenically unsaturated monomers to form a pigment dispersion in accordance with the invention, separating the milling media from the pigment dispersion, addition of other conventional addenda, including optionally additional monomers, forming droplet particles of the organic phase dispersion in an aqueous phase, and suspension polymerizing the ethylenically unsaturated monomers to solidify the droplet particles as disclosed, e.g., in U.S. Pat. 4,965,131.

The following polymeric milling media Variants 1 to 5 were prepared:

Milling Media Variant 1: 50 micron bead polymeric milling media comprising polystyrene crosslinked with divinylbenzene (95 wt % styrene, 5 wt % commercial divinylbenzene) was prepared by conventional limited coalesence techniques as follows:

2351 g of styrene, 124 g of divinylbenzene(55% grade from Dow Chemical Co.) and 65.7 g of benzoyl peroxide (sold as Lucidol 75 (25% water) by Pennwalt Corp.) were combined to form a monomer mixture. In a separate vessel containing 3300 g of demineralized water, 13.8 g of poly (2-methylaminoethanol adipate) and 22.4 g of Ludox TM (a 50% colloidal dispersion of silica sold by DuPont) were added. The monomer mixture was added to the aqueous phase and stirred to form a crude emulsion. This was then passed through a Gaulin colloid mill at 1.2 gallons/minute, 3300 rpm and gap setting=$^{10}/_{1000}$th inch. To this was added a solution of 8.2 grams of gelatin dissolved in 246 g of demineralized water. The mixture was heated to 67° C. for 16 hours followed by heating to 85° C. for 4 hours. The resulting solid particles were sieved through a 145 T sieve screen to remove oversized particles and the desired beads which pass through the screen were collected by filtration. The resulting solid particles collected by filtration were then washed with demineralized water, filtered and dried under vacuum for 3 days at 80° C.

Milling Media Variant 2: Polystyrene crosslinked with divinylbenzene beads were formed similarly as described for Variant 1, except the polymer comprised 70 wt % styrene, 30 wt % commercial divinylbenzene (55 wt % grade from Dow Chemical Co., remaining composition non-crosslinking monomer).

Milling Media Variant 3: Polystyrene crosslinked with divinylbenzene beads were formed similarly as described for Variant 1, except the polymer comprised 50 wt % styrene, 50 wt % commercial divinylbenzene (55 wt % grade from Dow Chemical Co., remaining composition non-crosslinking monomer).

Milling Media Variant 4: Polystyrene crosslinked with divinylbenzene beads were formed similarly as described for Variant 1, except the polymer comprised 20 wt % styrene, 80 wt % commercial divinylbenzene (55 wt % grade from Dow Chemical Co., remaining composition non-crosslinking monomer).

Milling Media Variant 5: 50 micron bead polymeric milling media comprising Polymethylmethacrylate crosslinked with divinylbenzene (70 wt % polymethylmethacrylate, 30 wt % commercial divinylbenzene) was prepared by conventional limited coalesence techniques as follows:

To a mixture of 1732.5 grams of methyl methacrylate and 742.5 grams of divinylbenzene(55% grade from Dow Chemical Co.) was dissolved 24.75 grams of 2,2'-azobis(2, 4-dimethylvaleronitrile) sold as Vazo 52 by the DuPont Company and 24.75 grams of 2,2' azobis(2 methylpentanenitrile) sold as Perkadox AMBN by AKZO Chemical. In a separate vessel was added 3.3 kg of demineralized water to which was added 0.5 grams of ferric sulfate pentahydrate, 11.9 grams of poly(2-methylaminoethanol adipate) and 16.2 grams of Ludox TM (a 50% colloidal dispersion of silica sold by Dupont). The monomers were added to the aqueous phase and stirred to form a crude emulsion. This was passed through a Crepaco homogenizer operated at 5000 psi. To this was added a solution of 8.2 grams of gelatin dissolved in 246 grams of demineralized water. The mixture was heated to 45° C. for 16 hours followed by heating to 85° C. for 4 hours. The resulting solid particles were sieved through a 145 T sieve screen to remove oversized particles and the desired beads which pass through the screen were collected by filtration. The resulting solid particles collected by filtration were then washed with demineralized water, filtered and dried under vacuum for 3 days at 80° C.

To measure the extent of swelling of the polymer Variants 1–5 in a solvent for the milling media, 0.5 gram sample of each composition was added to a 10 ml graduated cylinder followed by 5 grams of styrene or methyl methacrylate. The cylinders were allowed to stand four hours at 25° C. and the level of the swollen beads in the cylinder was measured. While each of the polymer Variants 1–5 were insoluble in the solvents, each exhibited swelling as indicated by the percentage change in bead level from the dry to swollen state as shown in Table 1 below:

TABLE 1

Swelling Results

| Polymer | Mole % Crosslinking monomer | Solvent | Vol. % Increase in 4 hrs |
|---|---|---|---|
| Variant 1 (95 wt % styrene/5 wt % commercial (55% assay) divinylbenzene) | 2.44 | styrene | 256 |
| Variant 2 (70 wt % styrene/30 wt % commercial (55% assay) divinylbenzene) | 14.0 | styrene | 50 |
| Variant 3 (50 wt % styrene/50 wt % commercial (55% assay) divinylbenzene) | 24.4 | styrene | 44 |
| Variant 4 (20 wt % styrene/80 wt % commercial (55% assay) divinylbenzene) | 42.0 | styrene | 10 |
| Variant 5 (70 wt % methylmethacrylate/30 wt % commercial (55% assay) divinylbenzene) | 13.6 | styrene | 11 |
| Variant 5 (70 wt % methylmethacrylate/30 wt % commercial (55% assay) divinylbenzene) | 13.6 | methyl methacrylate | 44 |

The various milling media were evaluated for their effectiveness to reduce particle size of pigments when milled in a liquid milling medium continuous phase comprising an organic solvent. One continuous phase of interest was a mixture of styrene and n-butyl acrylate at a ratio of three parts styrene to one part butylacrylate. A second continuous phase of interest was methyl methacrylate. All milling was done with a Laboratory Dispensator, Series 2000, Model 9C, manufactured by the Premier Mill Corporation. The starting pigments consisted of agglomerates nominally ranging in size from 0.1 to 2.5 microns, each having a average size of at least 0.5 micron. The pigments were selected from Pigment Red 122 (PR-122), Pigment Yellow 74 (PY-74), Pigment black 7 (PB-7), and a modified Pigment Blue 15 (PB-15) (bis(phthalocyanylalumino)tetraphenyldisiloxane).

EXAMPLE A 400 grams of milling media, Variant 3, 50 grams of Pigment Red 122, and 300 grams of styrene were combined and added to a 2 liter, jacketed, water cooled flask and subjected to shearing by means of a Premier mill adjusted to a speed of 3000 rpm. To this mixture was slowly added a solution of 12 grams of the dispersing polymer poly [t-butylstyrene-co-styrene-co-lithiosulfoethylmethacrylate (72/2414 wt ratio)] in 75 grams of styrene. The mill speed was increased to 7000 rpm and maintained at this speed for the remainder of the experiment (three hours). Initially the dispersion had a low viscosity which increased with time of milling until a thick paste was obtained resulting in reduced milling efficiency. Additional styrene monomer was added to the dispersion in order to maintain the dispersion viscosity at the optimum level of 1000 centipoise. The resulting pigment particles were removed from the milling media by means of filtration and subsequent washing on a fritted glass funnel. The resulting dispersion was then cooled. Dispersion stability was improved by the addition of a variety of charge stabilizers including polymers and surfactants, including poly[t-butylstyrene-co-lithiummethacrylate (98/2 wt ratio)]. Particle size of the resulting dispersion is given in Table 2.

EXAMPLES B–C

The procedure employed for example A was repeated except that the milling media Variant 3 was replaced with Variants 4 and 5, respectively. The samples were worked up in the same fashion and the results are given in Table 2.

EXAMPLES D–E

The procedure employed for example A was repeated except that the milling media Variant 3 was replaced with Variants 1 and 2, respectively. The milling process was stopped after about 30 minutes, however, due to excessive swelling of the milling media, which resulted in a jelled mass in the mill, prohibiting effective particle size reduction.

EXAMPLE F

Example B (employing milling media Variant 4) was repeated except the PR122 was replaced with the same quantity of PY-74. The resulting pigment particle size is given in Table 2.

EXAMPLE G

Example B was repeated except the PR-122 was replaced with the same quantity of modified PB-15 (bis (phthalocyanylalumino)tetraphenyldisiloxane). The resulting pigment particle size is given in Table 2.

EXAMPLE H

Example B was repeated except the PR-122 was replaced with the same quantity of carbon black (PB-7). The resulting particle size is given in Table 2.

EXAMPLE I

Example C (employing Variant 5) was repeated except that the styrene was replaced with the same quantity of methylmethacrylate as the dispersion continuous phase. The resulting particle size may be seen in Table 2.

TABLE 2

| | | Milling Results | | | |
|---|---|---|---|---|---|
| | | Particle Size (nm) | | | |
| Example | Media Variant | Number Average | Volume Average | Pigment | Observations |
| A | 3 | 30 | 96 | PR-122 | — |
| B | 4 | 10 | 18 | PR-122 | — |
| C | 5 | 16 | 33 | PR-122 | — |
| D (comp.) | 1 | — | >500 | PR-122 | Jelled |
| E (comp.) | 2 | — | >500 | PR-122 | Jelled |
| F | 4 | 12 | 21 | PY-74 | — |
| G | 4 | 14 | 31 | Mod. PB-15 | — |
| H | 4 | 48 | 105 | PB-7 | — |
| I | 5 | 23 | 49 | PR-122 | — |

The above results clearly demonstrate that the use of polymeric milling media Variants 3–5 which swell less than 50 vol. % in the liquid milling medium continuous phase in accordance with the invention results in effective milling, while the use of milling media Variants 1 and 2 which swell 50 vol. % or more in comparative Examples D and E does not, even where such polymeric media is sufficiently crosslinked to make the media insoluble in the liquid continuous phase.

We claim:

1. A process of forming milled solid particles of a compound comprising milling solid particles of the compound in a liquid organic medium continuous phase in the presence of polymeric milling media to reduce the average size of the compound particles, wherein the liquid continuous phase comprises a solvent for the milling media polymer in the uncrosslinked form and the milling media is crosslinked sufficiently to prevent swelling of the polymeric milling media in the liquid continuous phase to levels greater than or equal to 50 vol. % within four hours at 25° C.

2. The process of claim 1, wherein the polymeric milling media comprises media having a volume average particle size of less than 100 micrometers.

3. The process of claim 2, wherein the compound particles are milled to a volume average particle size of less than 100 nanometers.

4. The process of claim 3, wherein the compound comprises electrophotographic toner pigment.

5. The process of claim 4, wherein the liquid continuous phase comprises an ethylenically unsaturated polymerizable monomer.

6. The process of claim 5, further comprising forming electrophotographic toner particles by polymerizing the ethylenically unsaturated polymerizable monomer after the toner pigment compound is milled.

7. The process of claim 4, further comprising forming electrophotographic toner particles by separating the polymeric milling media from the milled toner pigment and liquid continuous phase, dissolving a polymer in the liquid continuous phase, forming organic phase droplets in an aqueous phase, and removing solvent from the organic phase droplets to solidify the droplets and form electrophotographic toner particles.

8. The process of claim 1, wherein the compound particles are milled to a volume average particle size of less than 100 nanometers.

9. The process of claim 1, wherein the compound comprises electrophotographic toner pigment.

10. The process of claim 9, wherein the liquid continuous phase comprises an ethylenically unsaturated polymerizable monomer.

11. The process of claim 10, further comprising forming electrophotographic toner particles by polymerizing the ethylenically unsaturated polymerizable monomer by suspension polymerization after the toner pigment compound is milled.

12. The process of claim 9, further comprising forming electrophotographic toner particles by separating the polymeric milling media from the milled toner pigment and liquid continuous phase, dissolving a polymer in the liquid continuous phase, forming organic phase droplets in an aqueous phase, and removing solvent from the organic phase droplets to solidify the droplets and form electrophotographic toner particles.

13. The process of claim 1, wherein the milling media polymer comprises crosslinked polymerized styrene and divinylbenzene monomers.

14. The process of claim 13, wherein the liquid continuous phase comprises an ethylenically unsaturated polymerizable monomer.

15. The process of claim 14, wherein the liquid continuous phase comprises styrene monomer.

16. The process of claim 15, wherein the compound comprises electrophotographic toner pigment, and further comprising forming electrophotographic toner particles by polymerizing the styrene monomer by suspension polymerization after the toner pigment compound is milled.

17. The process of claim 1, wherein the milling media polymer comprises crosslinked polymerized methyl methacrylate and divinylbenzene monomers.

* * * * *